United States Patent [19]

Takizawa et al.

[11] Patent Number: 4,682,878

[45] Date of Patent: Jul. 28, 1987

[54] FIXING DEVICES FOR ELECTROPHOTOGRAPHIC APPARATUS

[75] Inventors: Tatsuji Takizawa; Nobutaka Noda; Hideaki Takigawa, all of Tokyo, Japan

[73] Assignee: Katsuragawa Denki Kabushiki Kaisha, Tokyo, Japan

[21] Appl. No.: 855,428

[22] Filed: Apr. 24, 1986

[30] Foreign Application Priority Data

Apr. 30, 1985 [JP] Japan ..... 60-93232

[51] Int. Cl.[4] ..... G03G 15/20

[52] U.S. Cl. ..... 355/3 FU; 355/3 SH; 432/60; 100/151

[58] Field of Search ..... 355/3 FU, 3 SH, 3 R; 219/216; 432/60; 100/151, 152, 153

[56] References Cited

U.S. PATENT DOCUMENTS 4,275,876 6/1981 Imaizumi ..... 355/3 SH
4,362,502 12/1982 Motomura et al. ..... 355/3 FU
4,464,985 8/1984 Asanuma et al. ..... 355/3 FU
4,531,823 7/1985 Deguchi et al. ..... 355/3 TE
4,598,990 7/1986 Kusumoto et al. ..... 355/3 FU

*Primary Examiner*—R. L. Moses
*Attorney, Agent, or Firm*—Stevens, Davis, Miller & Mosher

[57] ABSTRACT

In a fixing device wherein a toner image formed on a copying paper by an electrophotographic copying machine is fixed while the copying paper is maintained in contact with the periphery of a heated fixing roller. Pressure is applied to the copying paper by a pressure applying device including an endless belt supported by a pair of spaced rollers which are mounted on a slidable plate. The slidable member is normally clamped at an operating position by a clamping member. When the clamping member is released, the slidable plate can be slid laterally to separate the endless belt from the fixing roller thereby enabling removal of jammed copying paper, exchange, repair and inspection of various elements of the fixing device.

11 Claims, 11 Drawing Figures

FIXING DEVICES FOR ELECTROPHOTOGRAPHIC APPARATUS

BACKGROUND OF THE INVENTION

This invention relates to a fixing device for use in an electrophotographic apparatus such as copying machine or printer.

In conventional electrophotographic apparatus, a light information corresponding to an object to be photographed is caused to illuminate a photosensitive element in the form of a rotary drum, for example, and an electrostatic latent image formed on the photosensitive element is developed into a toner image during a developing step. The toner image is then transfer printed onto a copying medium in the form of a sheet of paper or a resin film under an electric pressure, preferably by using a corona discharger. The copying medium which has been transfer printed with the toner image is separated away from the photosensitive element and then introduced into a fixing device through a guide plate or the like where the toner image on the copying medium is fixed. Generally, the fixing device is constituted by a fixing roller, an electric heating element contained in the fixing roller or disposed adjacent to the peripheral surface thereof, a pressure applying device in the form of rollers or an endless belt which conveys the copying medium while clamping the same between the pressure applying medium and the fixing roller, and such associated members as a peel off pawl and delivery rollers disposed about the fixing roller to cooperate therewith. The prior art fixing device has been incorporated into the electrophotographic apparatus, or constructed as a unitary unit to be removably incorporated into the electrophotographic apparatus.

For this reason, with the prior art fixing device, when the copying medium that is copying paper is jammed in the fixing device, such jammed copying paper cannot be removed readily. Moreover, the prior art fixing device accompanies such trouble as requiring considerable manual operations snd time for exchanging, inspecting and repairing the component elements of the fixing device and for exchanging offset preventing oil.

Moreover, when an endless belt is used for urging the copying paper agaisnt the fixing roller, although there is an advantage that the heating temperature and pressure can be made relatively low since the interval in which the endless belt is urged against the fixing roller is relatively long, there is another defect that since the pressure applied to the fixing roller is not uniform, portions which are unsatisfactorily fixed are liable to be formed.

Furthermore, since the endless belt tends to move transversely or to move in a wave form, not only the belt is broken but also the transfer copying medium, that is the copying paper is wrinkled, thereby forming portions not satisfactorily fixed.

SUMMARY OF THE INVENTION

Accordingly, it is an object of this invention to provide a novel fixing device for use in a copying machine capable of readily removing jammed copying medium and readily exchanging, inspecting and repairing the component elements of the fixing device.

Another object of this invention is to provide an improved fixing device of the type wherein an endless belt is used for urging the copying medium against a fixing roller, capable of uniformly urging the belt against the fixing roller, thus eliminating portions not satisfactorily fixed.

A further object of this invention is to provide a novel fixing device capable of preventing a transverse or wavy motion of an endless belt which is used to urge the copying medium against the periphery of the fixing roller.

According to this invention, these and other objects can be accomplished by providing a fixing device of the type comprising a fixing roller heated by heating means, and pressure applying means for fixing a toner image formed on a copying medium while the same is being clamped between the fixing roller and the pressure applying means to be conveyed in contact with the fixing roller, characterized in that the pressure applying means is mounted on a supporting member slidable with respect to a stationary member supporting the fixing roller, and that the fixing device further comprises positioning means for setting the supporting member at a predetermined position with respect to the stationary member, and clamping means for clamping the supporting member at a predetermined position of the stationary member.

DESCRIPTION OF THE PREFERRED EMBODIMENTS

Figure 2:
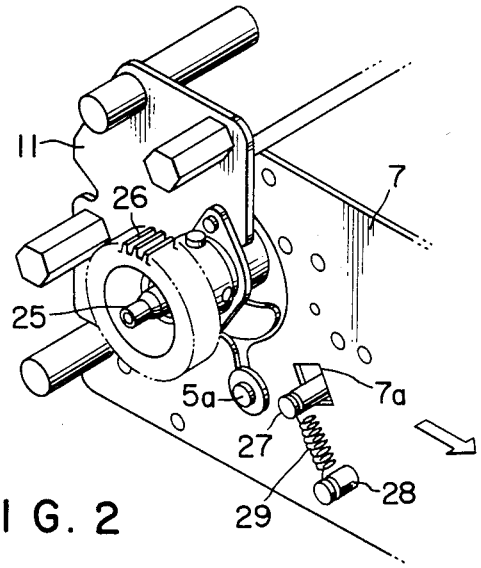
FIG. 2 is a perspective view showing a portion of the fixing device shown in FIG. 1.
Figure 3:
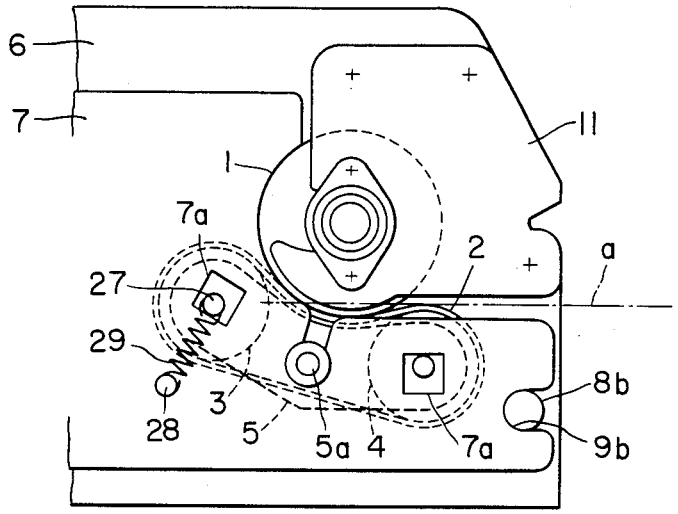
FIG. 3 is a side view showing a portion of the fixing device.

A preferred embodiment of the fixing device according to this invention and shown in FIGS. 1 to 3 will be described. The fixing device shown therein comprises a fixing roller 1 and a pressure applying member in the form of an endless belt 2 which urges copying medium, for example in the form of a sheet of paper, against the peripheral surface of the fixing roller 1. Usually, the fixing roller 1 is a hollow cylinder made of aluminum and the surface of the roller is coated with an offset preventing agent, ethylene tetrafluoride, for example. A rod shaped electric heater 50 is contained in the fixing roller 1. The endless belt 2 is passed about a plurality of, for example two, rollers 3 and 4 and the belt is urged against the peripheral surface of the fixing roller 1 between the pair of rollers 3 and 4 for increasing the contact area to the fixing roller 1. A supporting member 5 supporting the pair of rollers 3 and 4 is supported by a pivot shaft 5*a*. The fixing roller 1 is generally driven by an electric motor, not shown, and the endless belt 2 is driven by the frictional contact with the fixing roller 1.

The fixing device comprises a pair of side plates 6 on both sides of the main body, that is the stationary portion of the fixing device and other side plates 7 are slidably supported by side plates 6 to act as a supporting member. The fixing roller 1 is supported by side plates 11 integrally secured to side plates 6, while the pressure applying member constituted by endless belt 2, rollers 3 and 4 and pivot shaft 5*a* is installed between side plates 7. A suitable number of stop members 8*a* and 8*b* (in this example two) utilized for positioning are secured to side plates 6, and recesses 9*a* and 9*b* receiving the stop members are provided for the other side plates 7. Thus, by fitting stop members in corresponding recesses, side plates 7 can be positioned at suitable positions with respect to the side plates 6.

Figure 6:
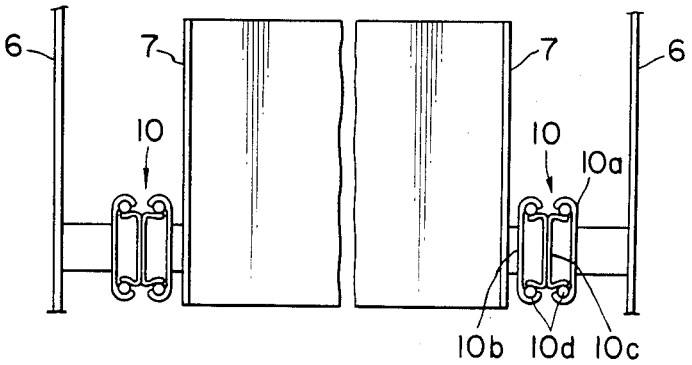
FIG. 6 is an elevational view showing one example of the sliding mechanism.

Although in this embodiment, the stop members 8*a* and 8*b* are secured to the side plates 6 on the side of the stationary portion, if desired the stop members can be secured to side plates 7 and the recesses can be provided for side plates 6. In the illustrated example, the supporting member is constructed to be slidable in a direction substantially perpendicular to the axis of the fixing roller 1. For this reason, as shown in FIG. 6, guide rails 10 are installed between the stationary side plates 6 and the movable side plates 7. Each slide rail 10 is made up of a stationary slide rail 10*a*, a movable slide rail 10*b*, an intermediate slide rail 10*c* and a series of balls 10*d* interposed between rails 10*s* and 10*c* end between rails 10*b* and 10*c*. The intermediate slide rail 10*c* is made up of two oppositely directed dish shaped members which are integrally bonded together. The slide mechanism may be any slide mechanism comprising guide members having a suitable form.

Figure 10A:
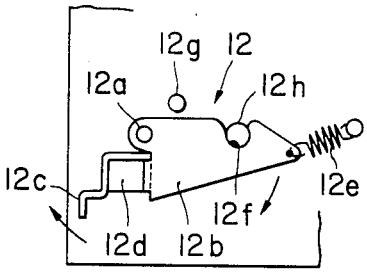
FIGS. 10A and 10B are side views showing one example of a clamping device.
Figure 10B:
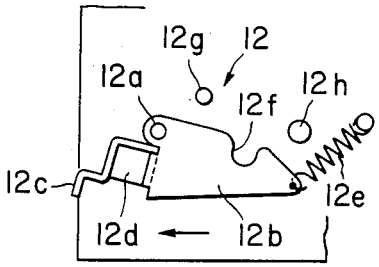

The fixing device further comprises a clamping device 12 clamping the side plates 7 supporting the endless belt 2 at a predetermined position of the side plates 6 on the side of the main body. When the clamping device is released, the side plates 7 are permitted to slide. One example of the clamping device 12 is illustrated in FIGS. 10A and 10B. Although any one of well known clamping devices may be used, the clamping device 12 shown in FIGS. 10A and 10B comprises a lever 12*b* pivotally mounted on a pivot shaft 12*a* extending between side plates 7. An interlocking member 12*d* having a handle 12*c* and a spring 12*e* is connected to the lever 12*b* which is formed with a recess 12*f*. A stop member 12*g* is provided to cooperate with the lever 12*b*. A stationary pin 12*h* is secured to the side plates 6. In a state shown in FIG. 10A the stationary pin 12*h* is received in the recess 12*f* of the lever 12*b*, thus locking the same. When the handle 12*c* is rotated in the clockwise direction as shown in FIG. 10B, the locking is released to permit the side plates 7 to slide.

Figure 1:
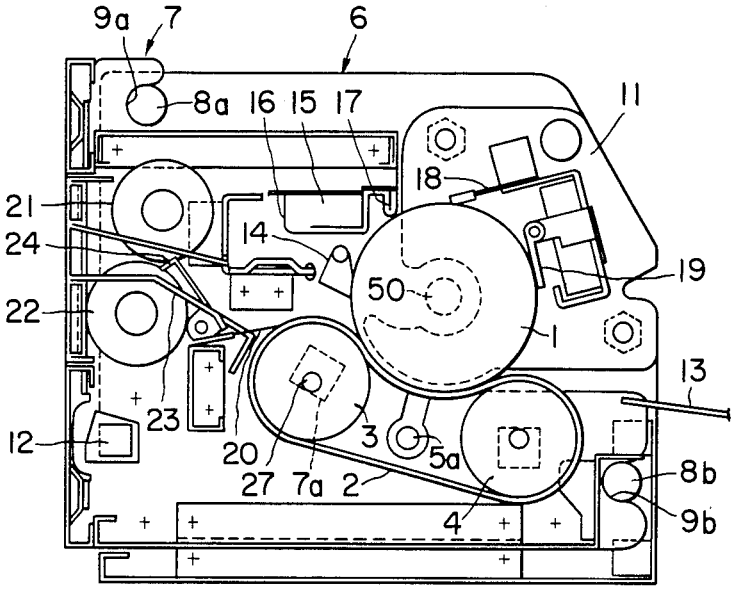
FIG. 1 is an elevational view showing the internal construction of one embodiment of the fixing device according to his invention.

As shown in FIG. 1, in addition to the members described above, the fixing device of this invention is provided with a guide plate 13 which guides to the fixing roller 1 a copying medium in the form of a sheet of paper peeled off from the photosensitive element, not shown, a peel off pawl 14 urged against the surface of the fixing roller 1 for preventing the paper from wrapping about the fixing roller 1, s container 16 adapted to contain oil 15 for preventing an offset, for example a silicone oil, an oil coating device 17 made of felt for supplying the oil to the surface of the fixing roller 1, a cleaning blade 18 made of such resilient plate as phosphor bronze and extending in a tangential direction of the fixing roller and carrying a rubber blade at the front end, and a temperature detector 19 which detects the surface temperature of the fixing roller 1 for ON-OFF controlling the electric heater through a suitable electric circuit.

For the purpose of conveying and delivering fixed papers to a tray, there are provided a copying paper peel off member 20 made of a polyimide resin or the like, the front end of the member 20 being urged against the surface of the endless belt 2 by the resiliency of the member 20, a pair of paper delivery rollers 21 and 22, a paper guide plate 23 guiding the paper to the paper delivery rollers, and a copying paper detecting actuater 24, after fixing. Although not shown in the drawing, a sensor or an actuater detecting the copying paper before fixing is arranged on the entry side of the fixing roller 1 for automatically deenergizing the electric heater when the paper is not detected by an actuator 24 on the outlet side a predetermined time after detection of the paper on the entry side. In FIG. 2, 25 designates a terminal of the electric heater 50 in the fixing roller 1, while 26 shows a gear driven by an electric motor, not shown, for rotating the fixing roller 1.

As above decribed, the supporting member 5 supporting rollers 3 and 4 about which endless belt 2 acting as the pressure applying device passes, is pivotally supported by pivot shaft 5*a* so that it is prefereble to construct the endless belt 2 to be swingable about the pivot shaft 5*a*. For this reason, as shown in FIGS. 2 and 3, a spring 29 is connected between the shaft 27 of roller 3 and a pin 28 secured to one side plate 7. With this construction, the range of swinging of supporting member 5 is limited by the shafts of rollers 3 and 4 and a motion limiting window 7*a* formed through one side plate 7, while endless belt is urged against the peripheral surface of the fixing roller 1 by the force of spring 29. Usually this spring is mounted on the outside of the side plate 7. The distance between axes of fixing roller 1 and of rollers 3 and 4 or the distance between the axes of rollers 3 and 4 may be changed for controlling the contact angle (or heating time) between the fixing roller 1 and the endless belt conveyor. Usually rollers 3 and 4 are made of aluminum and the endless belt is made of such heat resistant and elastic material as a silicone rubber.

Although in the illustrated embodiment the pivot shaft 5*a* is situated at a position intermediate of rollers 3 and 4, the pivot shaft can be positioned at another position of supporting member 5. For example, the shaft 27 of roller 3 may be used as a pivot shaft and the spring 29 can be mounted on another position.

Figure 4:
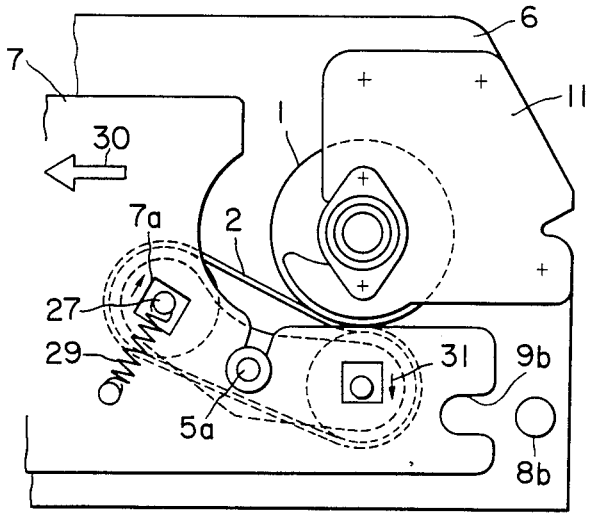
FIG. 4 is a side view similar to FIG. 3, wherein the supporting member of a pressure applying member is slid a little with respect to the main body of the fixing device.

More preferably, it is advantageous to construct such that the outer periphery of the fixing roller 1 contacts against the endless belt 2 but a portion of the fixing roller projects beyond a tangent a (see FIG. 3) to the surface of the endless belt 2 about one roller 4, the tangent a being parallel with the direction of sliding shown by an arrow 30 in FIG. 4. This arrangement not only makes compact the construction but also enables to apply a suitable pressure by the endless belt 2.

If desired, electric heaters may be incorporated into rollers 3 and 4 about which the endless belt 2 passes so as to heat the lower surface of the copying paper via belt 2. In this case, the rating of each electric heater may be lower than that of the electric heater 50 contained in the fixing roller 1 because the purpose of the electric heaters in the rollers 3 and 4 is merely to warm the copying paper. Instead of installing the electric heater in the fixing roller 1, the heater may be installed outside the fixing roller for heating the same from the outside.

In operation, a copying paper on which a toner image has been formed by a photosensitive drum is supplied between fixing roller 1 and endless belt 2 through guide plate 3. While passing through the contact surface between the fixing roller 1 and the endless belt 2, the toner image is fixed and then the paper is peeled off from the fixing roller 1 by peel off pawl 14. The peeled off paper is prevented from wrapping about the endless belt while it passes about roller 3 by peel off member 20. The paper is then discharged by paper delivery rollers 21 and 22 through guide plate 23. The discharged paper is detected by actuator 24.

Figure 5:
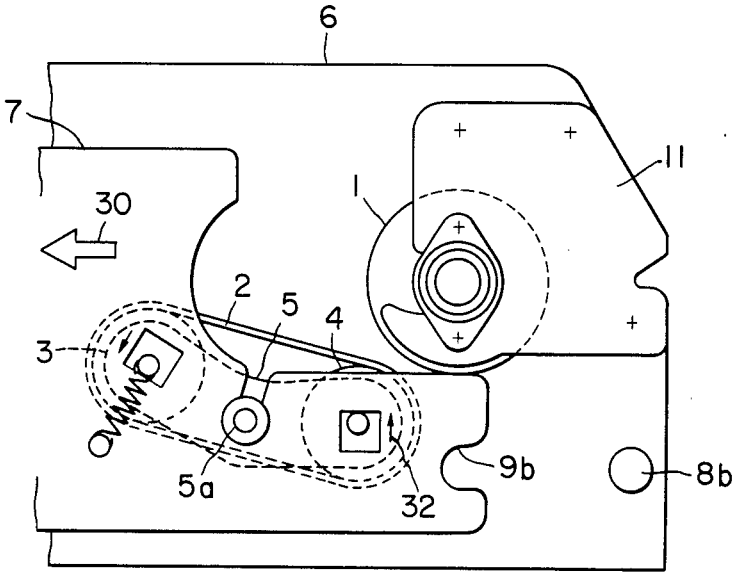
FIG. 5 is a side view similar to FIG. 4, wherein the supporting member is slid further.
Figure 7:
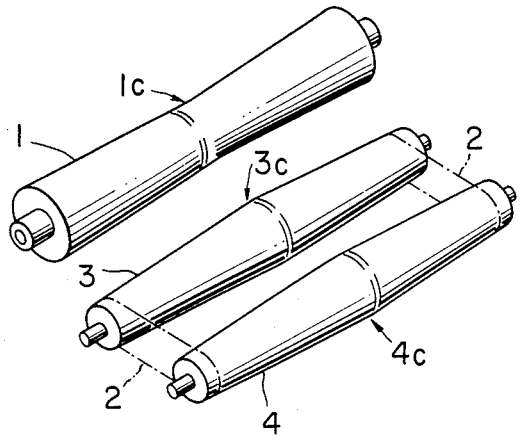
FIG. 7 is a perspective view shoing a fixing roller and a preferred example of crowned rollers around which an endless belt is passed.

When the paper is jammed between the fixing roller 1 and endless belt 2 whereby the movement of the paper is stopped, the clamp device 12 is released for removing jammed paper, and the side plates 7 are slid with respect to the main body for separating the endless belt away from the fixing roller 1. At this time, as shown in FIG. 4, the side plates 7 are slid slightly in the direction shown by arrow 30. When roller 4 comes to collide against the roller 1 with the endless belt interposed therebetween, the supporting member 5 and the roller 4 are pivotally moved slightly in a direction of arrow 31 against the force of spring 29, whereby the roller 4 is separated from the roller 1. When the roller 4 is sufficiently separated from the fixing roller 1, the supporting member 5 is pivotally moved in the counterclockwise direction shown by an arrow 32 in FIG. 5 against the force of spring 29, whereby an assembly of rollers 3 and 4 and endless belt 2 can be withdrawn from the main body. As shown in FIG. 7 it is advantageous to construct the fixing roller 1 as a reversely crowned configuration in which the diameter of the roller is the minimum at the central portion and then gradually increases toward opposite ends, whereas each of the rollers 3 and 4 is constructed to have a crowned configuration in which the diameter is the maximum at the central portion and decreases toward the opposite ends. As can be noted from FIG. 7, the outer surfaces of fixing roller and of belt supporting rollers 3 and 4 incline in the opposite directions, but their inclination angles are the same, so that these surfaces define gaps having uniform distances in the direction of the axes of these rollers. Where an endless belt is used, since it is possible to make relatively long the contact time between the belt and the fixing roller, there is an advantage that the temperature and pressure can be made relatively low. However, the endless belt is liable to be broken due to the wavy motion of the belt. In addition, the pressure between the fixing roller and the endless belt is not always uniform thus forming portions not sufficiently fixed. These defects can be obviated by constructing the fixing roller 1 and rollers 3 and 4 as shown in FIG. 7.

Figure 8:
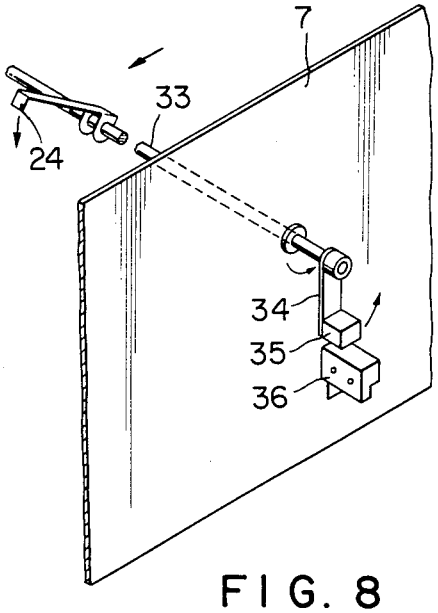
FIG. 8 is a perspective view showing one example of a sensing system for sensing a copying paper.

FIG. 8 shows a preferred form of the sensor related to the actuator 24. More particularly, the sensor is constituted by a permanent magent 35 supported by an arm 34 secured to an actuator shaft 33 snd a stationary magnetism sensing switch 36 which detects magnetic flux produced by magnet 35.

Figure 9:
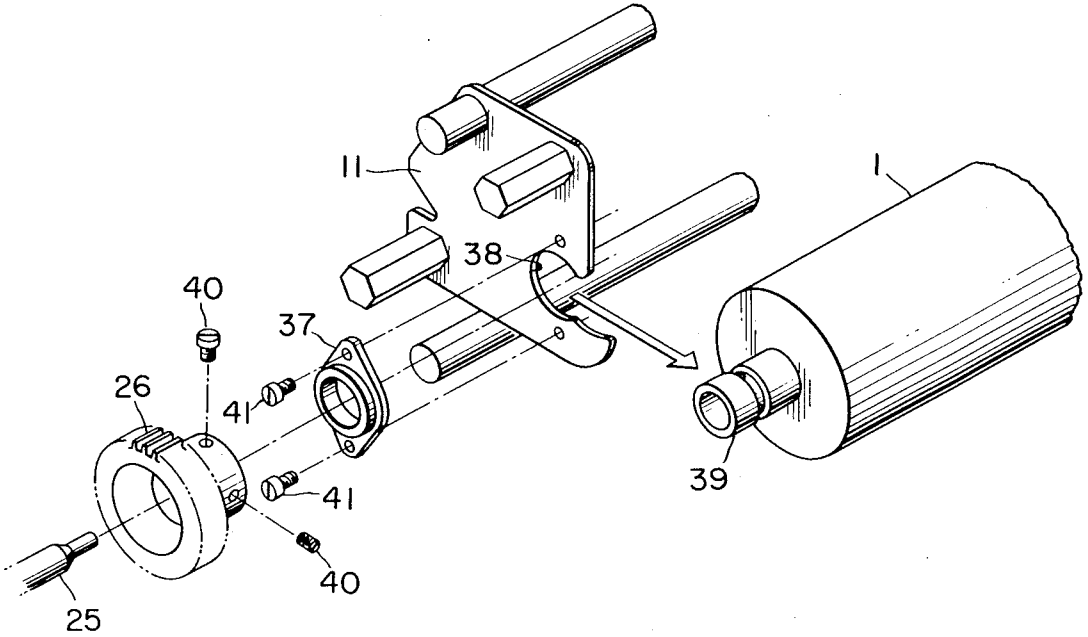
FIG. 9 is an exploded perspective view showing a state in which the fixing roller is dismounted.

FIG. 9 shows a state in which the fixing roller 1 is dismounted from stationary side plates 11. Usually, the shaft 39 of the fixing roller 1 is held in a notch 38 of the side plates 11 by means of an oilless bearing 37 which is secured to the side plates 11 by screws 41. The drive gear 26 is secured to shaft 39 by set screws 40. Consequently when the endless belt 2 is dismounted from rollers 3 and 4, the fixing roller 1 can also be readily dismounted. Removal of the endless belt 2 enables easy handling of other members.

As shown in FIG. 1 peel off pawl 14 and paper delivery rollers 21, 22 contributing to the peeling off and conveyance of the paper after fixing are mounted on the slidable side plates 7. Furthermore, container 16 for containing oil 15 utilized for preventing an offset and coating device 17 for coating the oil are also mounted on the side plates 17. This construction makes easy the inspection, exchange and handling of the elements described above.

Instead of using an endless belt as a pressure applying device, a mere pressure applying roller can be used. Further, instead of driving the endless belt with a frictional contact between the belt and the fixing roller, drive gears can be secured to either one or both of rollers 3 and 4 so as to mesh with gear 26 when the supporting device is mounted.

As above described, according to this invention, as the pressure applying device is separated away from the fixing roller when the supporting device is slid, copying paper jammed between the fixing roller and the endless belt can be removed readily. Moreover, removal of the pressure applying device renders easy the handling, exchange, inspection and repair of various elements constituting the fixing device.

What is claimed is:

1. In a fixing device of the type comprising a fixing roller heated by heating means, and pressure applying means for fixing a toner image formed on a copying medium while the same is being clamped between said fixing roller and said pressure applying means to be conveyed in contact with said fixing roller, the improvement wherein:

said pressure applying means is mounted on a supporting member slidable with respect to a stationary member supporting said fixing roller, and said fixing device further comprising:

positioning means for setting said supporting member at a predetermined position with respect to said stationary member, and clamping means for clamping said supporting member at a predetermined position of said stationary member.

2. The fixing device according to claim 1 wherein members including a peel off pawl and delivery rollers are mounted on said supporting member for conveying said copying medium after the same has been fixed.

3. The fixing device according to claim 1 wherein a container adapted to contain offset preventing oil and means for coating said fixing roller with said oil are mounted on said supporting member.

4. The fixing device according to claim 1 wherein said positioning means comprises a stop member provided for either one of said stationary member and said supporting member and a notch provided for the other one of said stationary member and said supporting member for receiving said stop member.

5. The fixing device according to claim 1 wherein said pressure applying means comprises a pair of spaced apart rollers, an endless belt passing about said rollers, and spring means for urging said endless belt against a peripheral surface of said fixing roller.

6. The fixing device according to claim 5 wherein said pair of rollers and said endless belt are supported by a supporting plate slidable with respect to said stationary member supporting said fixing roller.

7. The fixing device according to claim 6 wherein said supporting plate is swingable about a pivot shaft.

8. The fixing device according to claim 5 wherein said pair of rollers supporting said endless belt take the form of crowned rollers and wherein said fixing roller takes the form of a reversely crowned roller.

9. The fixing device according to claim 8 wherein a diameter of said fixing roller is a minimum at central portion and increases toward opposite ends of said fixing roller, and wherein diameters of said belt supporting rollers are maximum at central portions and decrease toward opposite ends of said belt supporting rollers.

10. The fixing device according to claim 9 wherein outer surfaces of said fixing roller and of said belt supporting rollers incline in the opposite directions, but inclination angles of said outer surfaces are the same.

11. The fixing device according to claim 5 wherein said spring means is provided between a pin provided for said supporting member and a shaft of one of said pair of rollers.

* * * * *